US006611104B1

(12) United States Patent
Kim et al.

(10) Patent No.: US 6,611,104 B1
(45) Date of Patent: Aug. 26, 2003

(54) COUPLING STRUCTURE OF WAVEGUIDE AND APPLICATOR, AND ITS APPLICATION TO ELECTRODELESS LAMP

(75) Inventors: Han-Seok Kim, Seoul (KR); Joon-Sik Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/627,057

(22) Filed: Jul. 27, 2000

(30) Foreign Application Priority Data

Dec. 29, 1999 (KR) ..... 1999-64807

(51) Int. Cl.[7] ..... H01J 65/04
(52) U.S. Cl. ..... 315/39; 315/248
(58) Field of Search ..... 315/39, 248

(56) References Cited

U.S. PATENT DOCUMENTS

| | | | | |
|---|---|---|---|---|
| 3,745,292 A | | 7/1973 | Couasnard | |
| 5,227,698 A | * | 7/1993 | Simpson et al. | 315/39 X |
| 5,370,765 A | | 12/1994 | Dandl | 156/643 |
| 5,521,360 A | | 5/1996 | Johnson et al. | 219/719 |
| 5,538,699 A | | 7/1996 | Suzuki | 118/723 MW |
| 5,975,014 A | | 11/1999 | Dandl | 118/723 MW |

FOREIGN PATENT DOCUMENTS

| | | |
|---|---|---|
| JP | 02-098096 | 4/1990 |
| JP | 04-020002 | 1/1992 |
| JP | 05-345982 | 12/1993 |
| JP | 08-046408 | 2/1996 |
| JP | 08-222187 | 8/1996 |

* cited by examiner

*Primary Examiner*—Benny T. Lee
(74) *Attorney, Agent, or Firm*—Birch, Stewart, Kolasch & Birch, LLP

(57) ABSTRACT

A coupling structure of a waveguide and an applicator including: an electromagnetic wave generator; a waveguide for transmitting an electromagnetic wave generated by the electromagnetic wave generator; and an applicator for receiving the electromagnetic wave through the waveguide and transmitting it to a lamp bulb, wherein the wall of the waveguide and the applicator are partially or wholly held in common, on which at least two slots are formed, so that when the electromagnetic wave reflecting from the applicator is directed to the waveguide, it does not go back toward the electromagnetic wave generator. According to the coupling structure of a waveguide and an applicator of the present invention, variation of the load does not affect the electromagnetic wave generator, without requiring expensive devices such as a waveguide tuner or a circulator, so that the life of the electromagnetic wave generator is increased and the system is stably operated all the time. Also, the stopping time of the system for the replacement of the electromagnetic wave generator can be reduced. In addition, the matching state of the system does not need to be adjusted over the variation of the load state. Using the tuner accompanies an inconvenience that the matching state should be adjusted according to the variation of the load state, but in the present invention, a load of different kinds or different characteristics can be used without changing the system.

26 Claims, 7 Drawing Sheets

COUPLING STRUCTURE OF WAVEGUIDE AND APPLICATOR, AND ITS APPLICATION TO ELECTRODELESS LAMP

BACKGROUND OF THE INVENTION

1. Field of the Invention

The present invention relates to a coupling structure of a waveguide and an applicator, and more particularly, to a coupling structure of a waveguide and an applicator which is capable of controlling propagation of an electromagnetic wave generated by an electromagnetic wave generator to be transmitted to an applicator in one direction, and of maintaining a stable operation even though the state of a load is varied.

2. Description of the Background Art

A system, in which the electromagnetic wave generated by an electromagnetic wave generator such as a magnetron is transmitted through a waveguide to a load inside an applicator, is used in various fields such as a microwave oven, an electrodeless lamp or a heating instrument.

Generally, this type of applicator includes a waveguide type or a cavity type. The cavity type applicator consists of a resonant type and a non-resonant type, and the waveguide type applicator consists of a cylindrical type and a rectangular type according to the shape of its cross-section. The waveguide type applicator utilizes either $TE_{mn}$, or $TM_{mn}$ modes of electromagnetic field distribution inside the waveguide. Here, 'm' and 'n' are natural numbers inclusive of '0'.

In general, the mode with the smallest cutoff frequency for a given dimension of a waveguide, or the mode formed by an electromagnetic wave of the lowest frequency that can propagate in a waveguide is called the dominant mode, and in this respect, in case of the cylindrical type waveguide, its dominant mode is $TE_{11}$, while that of the rectangular type waveguide is $TE_{10}$.

The resonant type cavity is classified into $TE_{mnp}$ and $TM_{nmp}$ types depending on the electromagnetic field distribution mode inside the cavity, and if a cavity is capable of supporting plural modes therein at the same time, it is called a multi-mode cavity. A typical example of the multi-mode cavity is that of a microwave oven.

In most cases, the load inside the applicator is in a solid state or in a liquid state, but gas also can be the load, for example, in case of a plasma generator. The load may have various shapes, and may be fixed or moving.

Conventionally, it has been hard to maintain a stable operation due to the change of the load state.

For example, referring to the electrodeless lamp, it is very difficult to simultaneously satisfy conditions for igniting a lamp bulb and for maintaining stable operation of the lamp. The impedance of the lamp bulb or resonator including the lamp bulb varies significantly depending on the state of the lamp bulb.

That is, since the impedance of the bulb in different states, for example, when it is cold with no discharge, when it starts to discharge, or when the lamp is fully activated and maintain a steady state, when matching is made for a specific state, other states are considerably mismatched.

Therefore, even if the lamp bulb is ignited and initial discharge is activated, the lamp bulb is likely to be turned off while it is proceeding to a stable state, or even though the lamp bulb reaches the stable state, since the impedance matching of the bulb to the electromagnetic wave becomes poor, the overall luminous efficiency of the system is significantly degraded.

In order to avoid the loss of efficiency, generally, impedance matching of the system is set at a value at which the lamp bulb is in a stable state of operation. However, in this case, since the matching in the initial state of the lamp bulb is not properly made, the electromagnetic wave applied to the resonator is mostly reflected back to the magnetron. Due to the reflected electromagnetic wave, the electric field inside the resonator is not strong enough to ignite the lamp bulb in it, and thus it is difficult to ignite the lamp bulb. In addition, the magnetron may operate unstably or oscillate abnormally, or the temperature of the magnetron may rise, so that the durability of the magnetron is decreased significantly. In this case, in order to ignite the lamp bulb, resonators of complicated shapes are used, or a device that helps to ignite the lamp bulb is added in the resonator. However, its expense is inevitably increased and its structure becomes complicated. Also, with these methods, the problem of the abnormal operation or the short life of the magnetron is not solved.

Meanwhile, when the characteristic impedance of the load system to the electromagnetic wave, that is, the combined impedance of the applicator and the bulb inside it, and that of the waveguide transmission line do not agree, electromagnetic waves reflect back from the applicator. In this case, as the reflected energy returns back to the electromagnetic wave generator, it has an adverse effect on the electromagnetic wave generator by disturbing stable operation of it, or is absorbed as heat in the electromagnetic wave generator, thereby shortening its life, or even destroying it. Therefore, a tuner or a circulator is generally used to protect the generator and to ensure proper matching.

FIG. 1 is a schematic view of a structure of a waveguide system in accordance with conventional art.

The tuner 2 controls the characteristic impedance of the waveguide transmission line. A directional coupler 4 of FIG. 1 extracts a predetermined fraction of the electromagnetic wave that proceeds toward the load 6 or turns back after reflecting from the load in the applicator 5. In order to maintain a good matching state in the transmission line, a wattmeter 3 is connected to the directional coupler 4 and the tuner 2 is adjusted so that the reflected wave is minimized.

Reference numbers 1 and 2 in FIG. 1 show a magnetron and a waveguide, respectively.

However, the conventional art has disadvantages in that the tuner 2 needs to be adjusted according to the state of the load in order to maintain the matching satisfactorily. Especially, in case that the characteristics of the load 6 varies during its operation, the tuner 2 needs to be continuously adjusted. Moreover, if the impedance of the load 6 changes irregularly or drastically, it is difficult to maintain a favorable matching state.

In addition, using the tuner 2, the directional coupler 4, and the wattmeter 3 or circulator causes an increase in expense and the overall size of the system to be enlarged and complicated.

Therefore, a new waveguide structure for overcoming the shortcomings of the conventional art is required.

SUMMARY OF THE INVENTION

Therefore, an object of the present invention is to solve the problem in a system in which an electromagnetic wave is transmitted from an electromagnetic wave generator to an applicator, and in which energy reflected due to the variation of the load characteristics is returned to the electromagnetic wave generator, degrading the characteristics of the electromagnetic wave generator.

Another object of the present invention is to eliminate the inconvenience of adjusting a tuner in a waveguide structure in response to occasional variation of the load characteristics.

To achieve these and other advantages, and in accordance with the purposed of the present invention, as embodied and broadly described herein, there is provided a coupling structure of a waveguide, and an applicator including: an electromagnetic wave generator, a waveguide for transmitting an electromagnetic wave generated by the electromagnetic wave generator; and an applicator for receiving the electromagnetic wave through the waveguide and applying it to a lamp bulb, wherein the walls of the waveguide and the applicator are partially or wholly shared, said wall having slots formed thereon, and the length of the waveguide is equal to an integer times one-half of the wave length of the electromagnetic wave that is guided through the waveguide.

At least two slots are formed at certain intervals on the wall held in common by the waveguide and the applicator, causing the electromagnetic wave reflecting from the applicator to not return back to the electromagnetic wave generator when it is directed to the waveguide.

The interval between center points of the slots is equal to approximately one fourth of the wave length of the electromagnetic wave transmitted in the waveguide. The width of the slot is preferably more than three times the thickness of the wall where the slots are installed.

The waveguide is rolled in a cylindrical form centering around the axis of the resonator, so that the propagation trajectory of the electromagnetic wave within the waveguide forms a concentric circle or a concentric circular arc to the cross section of the resonator.

An electromagnetic wave absorbing unit is additionally provided at an end portion of the waveguide in the propagation direction of the electromagnetic wave, so as to absorb the electromagnetic wave still proceeding inside the waveguide without being coupled to the applicator, and the electromagnetic wave returning to the waveguide is being reflected from the applicator and proceeding in its initial direction (that is, the opposite direction to the electromagnetic wave generator). As for the absorbing unit, carbon, graphite or water may be used therefor.

Referring to the cross section shape of the applicator, a circular or an oval shape is appropriate, and as for the cross section of waveguide, a semicircular, a circular, or an oval shape is appropriate.

To achieve the above objects, there is also provided an electrodeless lamp including: an electromagnetic wave generator; a waveguide guiding the electromagnetic wave generated by the electromagnetic wave generator; a resonator for receiving the electromagnetic wave from the waveguide and applying it to a lamp bulb; and an electrodeless bulb within the resonator, wherein the wall of the waveguide and the applicator are partially or wholly held in common, on which slots are formed, so that the electromagnetic wave does not return back toward the electromagnetic wave generator when it is reflected from the resonator, and the length of the waveguide is equal to an integer times one-half of the wave length of the electromagnetic wave guided within the waveguide.

BRIEF DESCRIPTION OF THE DRAWINGS

The accompanying drawings, which are included to provide further understanding of the invention, and are incorporated in and constitute a part of this specification, illustrate embodiments of the invention, and together with the description serve to explain the principles of the invention.

In the drawings:

FIGS. 2A and 2B illustrate a structure of a waveguide in accordance with one embodiment of the present invention, of which FIG. 2A is a front-sectional view of the waveguide; and FIG. 2B is a side view of the waveguide;

FIGS. 5A and 5B show a structure of a waveguide adopted to an electrodeless lamp in accordance with one embodiment of the present invention, of which:

FIG. 5A is a side-sectional view of the waveguide; and

FIG. 5B is a front-sectional view of the waveguide;

FIGS. 9A and 9B show a structure of a waveguide adopted to an electrodeless lamp in accordance with another embodiment of the present invention, of which:

FIG. 9A is a side-sectional view of the waveguide; and

FIG. 9B is a front-sectional view of the waveguide;

FIGS. 10A through 10C are explanatory view showing general forms of a waveguide, of which:

FIG. 10A is a sectional view of a waveguide with a rectangular section;

FIG. 10B is a perspective view showing a structure of a cylindrical waveguide for 'E' side; and FIG. 10C is a perspective view showing a structure of a cylindrical waveguide for 'H' side;

FIGS. 11A and 11B show a structure of a waveguide adopted to an electrodeless lamp in accordance with still another embodiment of the present invention, of which:

FIG. 11 A is a side-sectional view of the waveguide; and

FIG. 11 B is a front-sectional view of the waveguide;

FIGS. 12A and 12B show a structure of a waveguide adopted to an electrodeless lamp in accordance with yet another embodiment of the present invention, of which:

FIG. 12A is a side-sectional view of the waveguide; and

FIG. 12B is a front-sectional view of the waveguide;

DETAILED DESCRIPTION OF THE PREFERRED EMBODIMENTS

Reference will now be made in detail to the preferred embodiments of the present invention, examples of which are illustrated in the accompanying drawings.

A first feature of the present invention is that slots are formed in a directional coupling structure.

Figure 1:
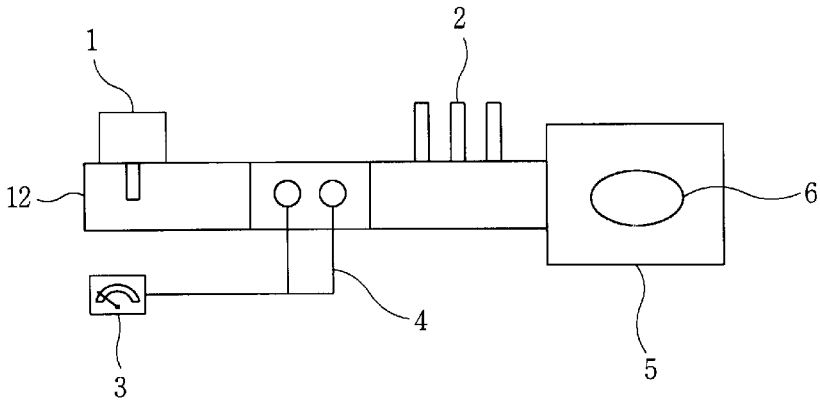
FIG. 1 CONVENTIONAL ART
FIG. 1 is a schematic view showing a structure of a waveguide system in accordance with conventional art.
Figure 2A:
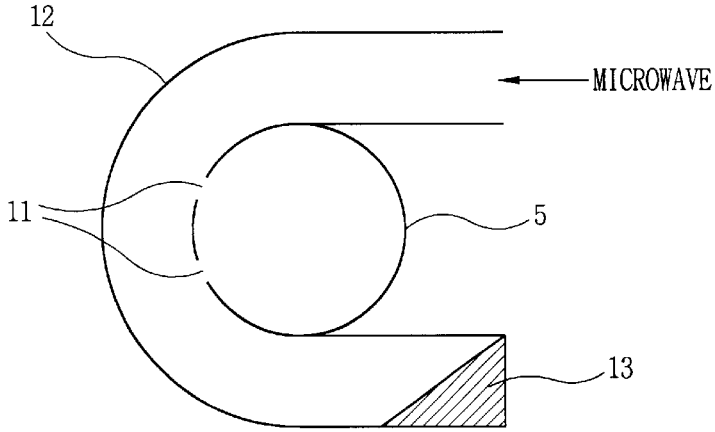
Figure 2B:
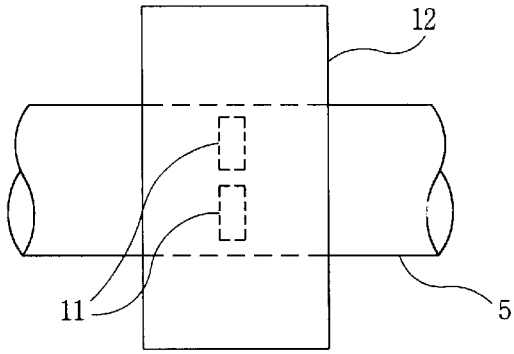

FIGS. 2A and 2B illustrate a structure of a waveguide in accordance with one embodiment of the present invention, which includes a waveguide 12 for guiding an electromagnetic wave from an electromagnetic wave generator that generates a microwave electromagnetic wave (see FIG. 2A); an applicator 5 for applying the transmitted electromagnetic wave to a load; slots 11 in a directional coupling structure for coupling the waveguide 12 and the applicator 5 so as to transmit the electromagnetic wave proceeding through the waveguide to the applicator 5, and an absorbing unit 13 (see FIG. 2A) installed at the end portion of the waveguide 12 in the progressive direction of the electromagnetic wave.

The wall of one side of the cylindrical applicator 5 and the wall of one side of the semicircle waveguide 12 are held in common, and two slots 11 are formed at an interval on a portion of the common wall.

FIG. 2B is a side-sectional view of the structure of the waveguide in accordance with the present invention. The electromagnetic wave generated by the electromagnetic wave generator proceeds to the absorbing unit 13 (see FIG. 2A) positioned at the end portion of the waveguide through the waveguide 12, and is also coupled to the load installed inside the applicator 5 through the coupling slots 11.

The directional coupling structure of the present invention is important in view of the fact that it prevents the electromagnetic wave generated by and transmitted from the electromagnetic wave generator from reflecting and turning back to the electromagnetic wave generator, rather than being entirely absorbed into the load inside the applicator 5.

Figure 3:
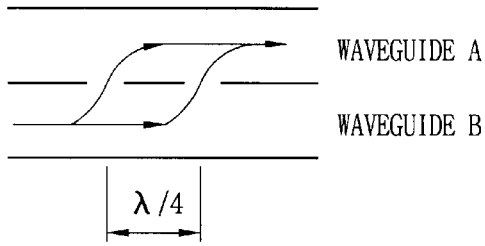
FIG. 3 CONVENTIONAL ART
FIG. 3 is a sectional view of a directional coupler of a general waveguide in accordance with the conventional art.

For a better understanding, FIG. 3 shows a general waveguide directional coupler. The electromagnetic wave propagating in one direction through the waveguide 'B' is partially transmitted to the waveguide 'A' through the two coupling slots (or holes) formed at a location at which an interval between central points thereof is approximately one-fourth of the wave length ($\lambda/4$), and in this respect, due to the mutual interaction by the two coupling slots, the electromagnetic wave propagates in one direction also in the waveguide 'A'.

That is, as to the electromagnetic wave that has passed through the two slots, a constructive interference is made in the progressive direction of the wave and a destructive interference is made in the opposite direction, resulting in that the electromagnetic wave in the waveguide 'A' proceeds in the same direction as that in the waveguide 'B'. Also, when the electromagnetic wave proceeding in the waveguide 'A' is combined with that in the waveguide 'B', it also proceeds in one direction.

The coupling structure of the waveguide and the applicator of the present invention is different from the general waveguide directional coupler in the aspect that most of the electromagnetic waves propagating in one waveguide is coupled to the other, rather than being partially coupled. This coupling can be accomplished by suitably selecting the length and the width of the slots formed on the waveguide and their relative positions.

Figure 4:
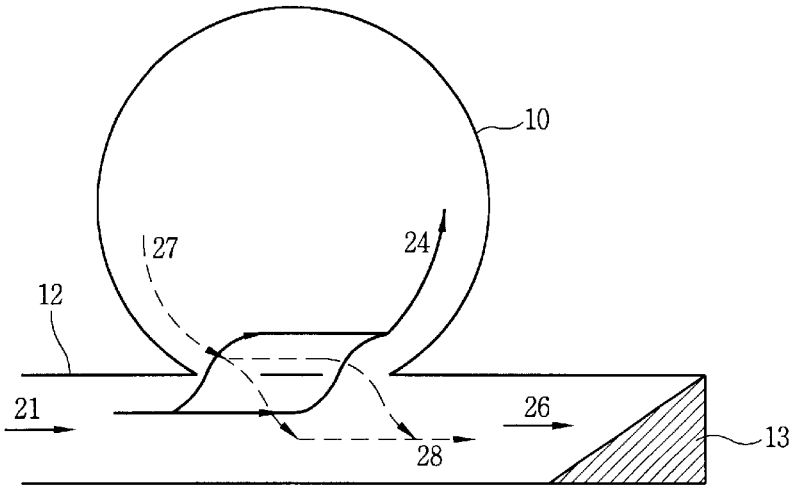
FIG. 4 is a sectional view of a waveguide in accordance with another embodiment of the present invention.

FIG. 4 is a sectional view of a system showing an operational principle in accordance with another embodiment of the present invention.

As shown in the drawing, the microwave electromagnetic wave 21 made incident on the waveguide 12 is mostly coupled into the applicator 10 through the slots formed on the wall held in common by the waveguide 12 and the applicator 10 when it is proceeding through the waveguide 12, and such coupled electromagnetic wave 24 is absorbed by the load inside the applicator 10.

At this time, if the impedance determined by the applicator 10 and the load therein is not identical to the impedance of the electromagnetic wave, a part of the electromagnetic wave is reflected therefrom rather than being absorbed. This reflected wave 27 is coupled back to the waveguide 12 through the slots.

The reflected wave 28 coupled back to the waveguide 12 and the still proceeding electromagnetic wave 26 that was not coupled to the applicator 10 out of the electromagnetic wave 21 made incident on the waveguide are transmitted to the absorbing unit 13 through the waveguide so as to be absorbed thereby. Accordingly, the electromagnetic wave transmitted to the waveguide 12 from the electromagnetic wave generator is wholly absorbed either by the load inside the applicator 10 or by the absorbing unit 13 at the end portion of the waveguide 12, without turning back to the electromagnetic wave generator.

According to an object of the present invention, a desirable form of the applicator is that its cross section has a circular or oval shape. A suitable type of applicator may be used according to the state of the load or the movement of the load.

In FIG. 4, the wall of the waveguide 12 and the wall of the applicator 10 are shown existing separately, only the slot portion held in common; nevertheless, the waveguide 12 and the applicator 10 may hold the wall partially or wholly in common depending on the object of use.

The structure of the waveguide 12 includes a plurality of slots or openings in a hole form in the proceeding direction of the waveguide. Though at least two slots are basically provided therein, more slots may be formed according to the objects of use. Also, the slots are not necessarily provided in even numbers, so that they may be provided in odd numbers.

The interval between central points of the slots is basically one-fourth of the wave length inside of the waveguide as the conventional waveguide-type directional coupler. The intervals may be modified according to the structure of the waveguide and the applicator in practical use, that is, its size, its form and its operation method. Also, the intervals between slots are not necessarily the same distance from each other, and several slots may be divided into several groups to be placed appropriately.

The slots may have various shapes such as rectangular, circular, or oval shapes as desired, and are not necessarily the same dimension, that is, the width and the length.

In other words, the waveguide structure of the present invention refers to an arrangement of the slots in suitable number within the waveguide according to the waveguide and the applicator for use, of which characteristics are optimized by the number, shape and interval of the slots, its form and the intervals in their arrangement.

Figure 5A:
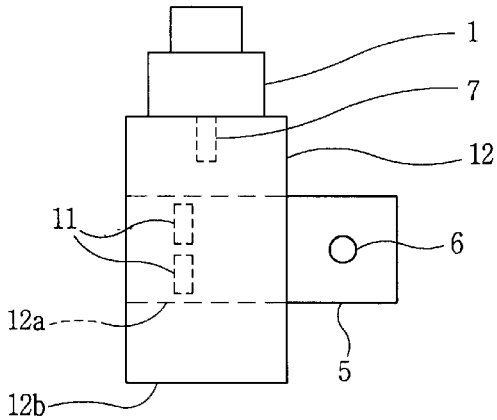
Figure 5B:
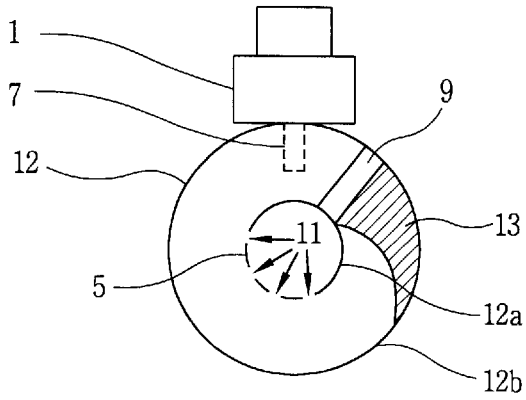

For each embodiment shown in FIGS. 5A, 5B, 6, 7, 8, 9A, 9B, 10A, 10B, 10C, 11A, 11B, 12A, and 12B, reference numeral 1 designates a magnetron, reference numeral 5 designates an applicator, reference numeral 6 designates a bulb, reference numeral 7 designates an antenna, reference numeral 9 designates a separating wall, reference numeral 11 designates a slot or slots and reference numeral 12 designates a waveguide. Where a particular element in a figure is presented with a label, but not discussed, it is so presented for the purpose of adding clarity or to better explain the invention. FIGS. 5A and 5B show structures of a waveguide adopted to an electrodeless lamp that is excited by microwaves in accordance with one embodiment of the present invention.

As shown in FIGS. 5A and 5B, the electromagnetic wave generated by the magnetron 1 proceeds through the waveguide 12 and is coupled to the applicator 5 through the slots 11, which then excites the material in the bulb 6 within the applicator 5, thereby generating a light such as a visible light or an ultraviolet light.

The inner and outer wall 12*a* and 12*b* of the waveguide 12 are made of two concentric cylinders, where the entire inner wall 12*a* of the waveguide 12 share a part of the wall of the applicator 5.

The actual effective length of the waveguide 12 starts from one side of a separating wall 9 (see FIG. 5B) installed within the waveguide 12 and ends at the opposite side of the wall 9 in the circumferential direction.

An absorbing unit 13 (see FIG. 5B) is installed at the opposite side of the magnetron antenna 7 within the waveguide 12, and four slots 11 are arranged on the inner wall 12*a* of the waveguide.

The slots 11 are formed along the length of the waveguide 12 and in a direction that crosses the axial direction of the applicator 5.

Figure 6:
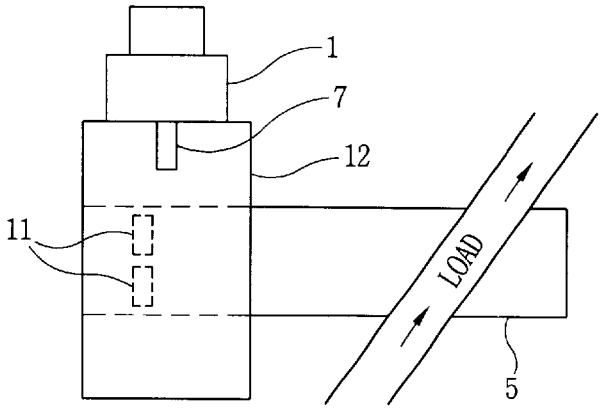
FIG. 6 is a sectional view showing a structure of a waveguide adopted to a heating system in accordance with the present invention.

FIG. 6 is a sectional view showing a structure of a waveguide system adopted to a heating system having a liquid-type load in accordance with the present invention.

Referring to FIG. 6, the electromagnetic wave generated by the magnetron 1 is coupled to the applicator 5 (not shown herein) so as to heat the liquid-type load therein. The structure of the cylindrical waveguide 12 includes two slots 11 and the applicator 5 is of a cylindrical waveguide structure using $TE_{11}$ mode.

Inside the applicator 5, a pipe made of an insulator having a property of small dielectric loss and strong resistance to heat, such as TEFLON™ (a polymer having excellent resistance to chemicals and good thermal resistance), is installed at a slant, through which liquid passes to be heated.

Since the dielectric constant of the load or the absorption ratio of the electromagnetic wave varies depending on the condition of the liquid such as kind of liquid, temperature and density, the amount of the reflected electromagnetic wave that is not absorbed by the load varies accordingly, depending on the operational condition, is ultimately absorbed in the absorbing unit (not shown) installed at the end portion of the waveguide.

Another feature of the present invention is that the waveguide is purposely made to serve as a resonator under certain condition.

The length of the waveguide is defined from the wall of the rear side of the magnetron antenna 7 to the wall of the end of the opposite side in the progressive direction of the electromagnetic wave.

If the waveguide has a length equal to an integer times one-half of the wave length (that is, $n\lambda/2$, 'n' is integer) inside the waveguide, the waveguide itself is able to serve as a resonator.

In a case where the facing two sides constructing the waveguide 12 are curved in a cylindrical shape, that is, the propagating direction of the electromagnetic wave within the waveguide 12 is a curved line rather than a straight line, the electrical length of the waveguide is computed by an expression according to an electromagnetic theory. Substantially, the length can be almost accurately obtained by using an average distance computed along the middle of the two curved sides.

The propagating direction of the electromagnetic wave within the waveguide 12 and the cross section of the resonator form concentric circles holding the same axis in common, and the resonator and the waveguide partially share a common wall.

The electromagnetic wave within the waveguide 12 propagates along a circular trajectory and is transmitted to the resonator through the coupling slot installed on the common wall the waveguide and of the resonator, so as to be applied to the load therein.

Since the waveguide 12 serves as a resonator (termed as a 'first resonator', hereinafter), a stable operation state can be maintained according to the state of the load inside the applicator.

In, for example, an electrodeless lamp, the electric field strength in the resonator including the bulb is maintained to be high enough, so that the lamp bulb can be ignited easily, when the lamp is turned on.

That is, when the lamp is started, a standing wave is generated in the waveguide, that is, the first resonator, before the bulb is completely ignited, and the second resonator is excited by the standing wave.

This double resonance principle is explained with reference to FIG. 7.

Figure 7:
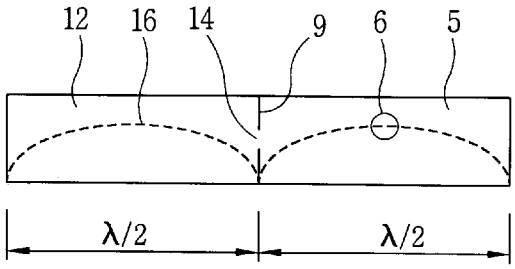
FIG. 7 is a sectional view explaining a principle of a double resonance, showing an electric field intensity when a lamp bulb is actuated.

As shown in FIG. 7, first, a resonator is formed by blocking both ends of the waveguide of which electrical length is the same as the guided wave length ($\lambda/2$) thereof. In this respect, if the waveguide 12 has a rectangular cross section, it corresponds to a resonator operating in the $TE_{102}$mode, while if the waveguide has a circular cross section, it corresponds to a resonator operated in the $TE_{112}$mode.

The electromagnetic wave within the resonator forms a standing wave, and the distribution of the electric field strength 16 is shown as a dotted line as illustrated in FIG. 7. Here, the electric field strength in the middle point of the resonator is '0', and even if this point is blocked by a conductor wall 9, there is no variation in a boundary condition, the distribution of the electric field is maintained as it is and the two spaces divided by the conductor wall 9 respectively forms independent resonators 12 and 5.

When a coupling slot 14 is formed on the wall 9, the two resonators, that is, the first and the second resonators 12 and 5 are connected to each other, still maintaining the original electric field distribution.

At this time, when the bulb 6 is installed at the center of the second resonator 5, that is, at the position where the electric field is the strongest, since the bulb 6 does not absorb the electromagnetic wave before it is ignited, the electromagnetic wave applied to the second resonator 5 through the first resonator 12 (waveguide) is mostly reflected and turned back to the first resonator 12. This forms the standing wave within the first resonator 12, which is transmitted again to the second resonator 5 with the same phase all the time, so that a strong electric field is continuously applied to the bulb 6 by maintaining the standing wave pattern within the second resonator 5 due to the constructive interference.

Meanwhile, in case that the waveguide region does not serve as a resonator, since the phase of the standing wave generated in the waveguide becomes different from that of the standing wave of the second resonator 5, the resonance (standing wave) pattern in the second resonator is changed, making it difficult to light the bulb 6.

Figure 8:
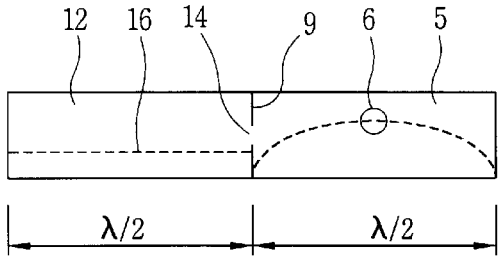
FIG. 8 is a sectional view explaining a principle of a double resonance, showing an electric field intensity after a lamp bulb is actuated.

After the bulb 6 is fully ignited, the electromagnetic energy applied to the bulb is mostly absorbed by the bulb 6, and only a minimal amount of electromagnetic waves return to the first resonator 12. In this case, the first resonator 12 is not operated as a resonator but operated as a normal waveguide. An electric field strength 16 at this time is shown as a dotted line as illustrated in FIG. 8. At this time, there is no standing wave within the waveguide 12, so that the electric field strength 16 within the waveguide becomes even.

The coupling slot 14 is designed so that the electromagnetic wave within the first resonator (waveguide) 12 is effectively coupled to the second resonator 5, and installed on the wall between the waveguide 12 and the second resonator 5 in the progressive direction of the electromagnetic wave. It is desirable to determine the position, length and width of the slot 14 so that satisfactory matching is achieved when the bulb 6 is in its normal operating state.

Referring to the shape of the slot 14, a rectangularly shaped one is generally used; however, any modification to its shape is possible in view of a desired characteristic and for better performance, for example, a slot end portions being round-shaped, can also be employed.

It is also possible to have more than one slot when necessary. In the present invention, since the slots are installed in the circumferential direction on the wall of the resonator, compared to that of the conventional art, it is very advantageous to arrange a plurality of slots.

Especially, as to the coupling slot, it is desirable to use the directional coupling slots 14, having advantages in that it can improve the matching characteristics with the second resonator 5, and an electromagnetic wave having a circular (rotating) polarization characteristic can be coupled into the second resonator 5.

In case that the second resonator 5 is excited by a circularly polarized wave, since the electric field rotates centered around the axis of the resonator 5 when it is viewed in the cross-section side of the resonator 5, the electric field is evenly applied along the circumference of the bulb 6, so that possible damage to the bulb 6 due to a local heating on the surface of the bulb 6 can be prevented, and accordingly, the bulb 6 does not need to be rotated to prevent local heating.

Figure 9A:
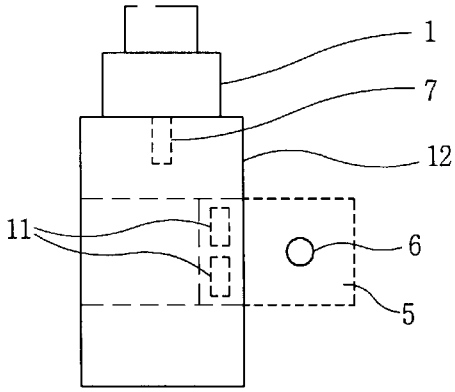
Figure 9B:
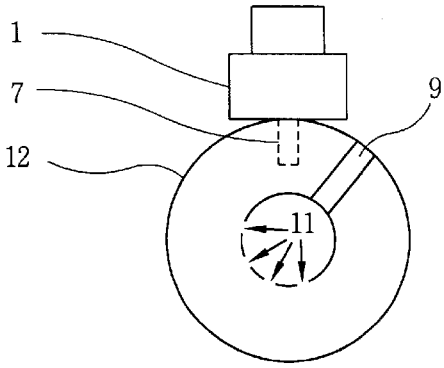

FIGS. 9A and 9B shows another embodiment of a microwave electrodeless lamp for generating visible light in accordance with the present invention.

The waveguide 12 is operated in the $TE_{10}$ mode, which has a rectangular cross section and rolled in a cylindrical form.

Figure 10A:
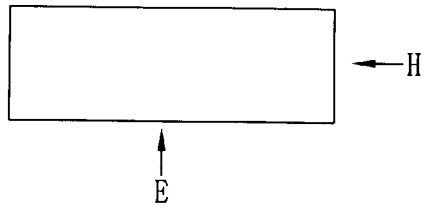

Generally, the rectangular waveguide is fabricated to have the ratio of 2:1 for its width and length. In this case, as shown in FIG. 10A, the wide side is referred to as 'E' side, while the narrow side is referred as 'H' side.

Figure 10B:
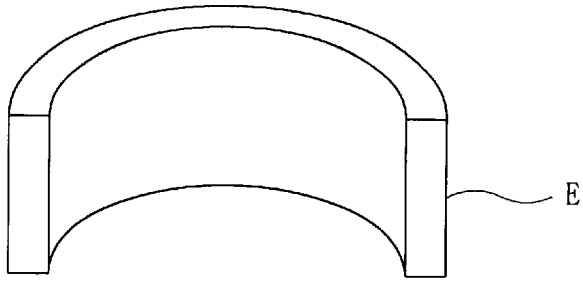
Figure 10C:
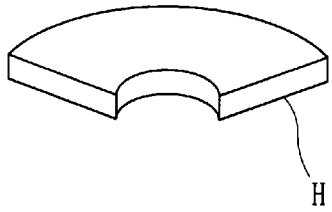

FIGS. 10B and 10C respectively show a rectangular waveguide rolled structure over the 'E' side and 'H' side.

Referring to FIGS. 9A and 9B, the first resonator of the internal region of the waveguide 12 is operated in the $TE_{104}$ mode, and the second resonator 5 in a cylinder form is operated in the $TE_{111}$ mode. The waveguide and the second resonator 5 share a part of the E side of the waveguide 12 in common. The other part of the wall of the resonator 5 that is not shared in common with the waveguide is mostly formed as a mesh screen, being substantially translucent for the light generated by the bulb 6.

The waveguide 12 and the second resonator 5 are combined by the jointly owned surface there between, that is, by the directional coupling slots 11 installed at the 'E' side of the waveguide.

The directional coupling slots 11 are constructed by arrangement of four slots, which are basically an array of two independent directional coupling slot structures placed consequently, each consisting of a pair of slots.

The interval between central points of the slots 11 is approximately one fourth the wave length of the electromagnetic waves passing through the waveguide 12. In this respect, since the phase difference of each slot is approximately 90°, a resonance mode having the rotating polarization characteristics, is generated within the second resonator 5. This makes the ignition of the bulb 6 easier, and the necessity to rotate the bulb 6 is reduced.

Regarding FIGS. 9A and 9B, the coupling slots are installed on the 'E' side of the waveguide 12, that is, the wide side. The reason for this is that the second resonator 5 jointly owns a portion of 'E' side of the waveguide 12. If the second resonator 5 jointly owns the 'H' side of the waveguide 12, that is, a part of the narrow side, the coupling slot 11 can be also installed on the 'H' side of the waveguide 12.

In the drawings, though the waveguide 12 is rolled in a cylindrical form, over the 'E' side, it is also possible to roll in the cylindrical form over the 'H' side of the waveguide 12, and in both cases, it is possible to install slots 11 on both the 'E' side and the 'H' side.

Figure 11A:
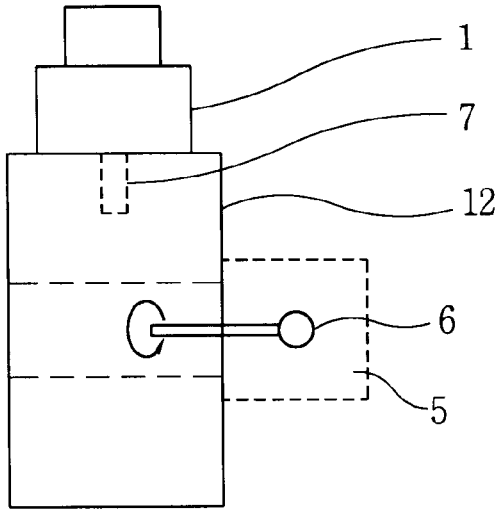
Figure 11B:
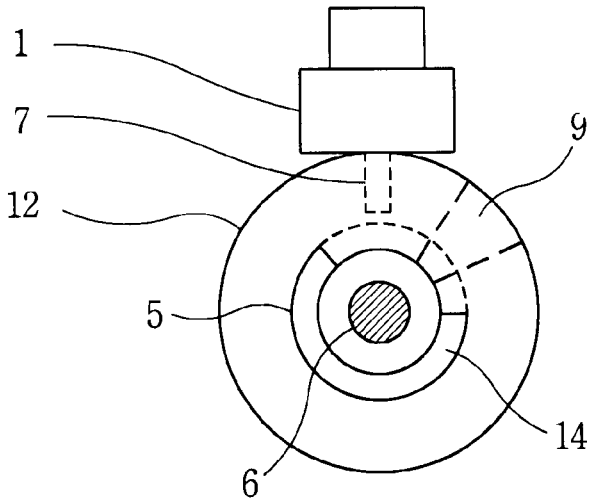

FIGS. 11A and 11B show a microwave electrodeless lamp using a magnetron operated at 2.45 GHz in accordance with another embodiment of the present invention.

As shown in FIGS. 11A and 11B, there is provided a waveguide 12 having a rectangular cross section which is operated in the $TE_{10}$ mode. The waveguide 12 is rolled over the 'E' side. Width and length of the cross section of waveguide 12 are approximately 80 mm and 40 mm, respectively, and the first resonator of the internal region of the waveguide 12 is operated in the $TE_{103}$ mode. The magnetron 1 is coupled to the outer wall of the waveguide 12.

The second resonator 5 is of a cylinder having a diameter of approximately 75 mm and operated in the $TE_{111}$ mode. The side wall and the front wall of the cylinder are made of a mesh screen, and its rear wall jointly owns the 'H' side of the waveguide 12.

In this embodiment, the waveguide 12 and the second resonator 5 are coupled by a traveling wave coupling slot 14 installed on the 'H' side (front surface) of the waveguide.

Preferably, the width of the slot 14 is more than three times the thickness of the wall where the slot 14 is installed. If the width of the slot is narrow, the quality factor Q becomes high, and when coupled to the unloaded resonator which is the case when the bulb 6 inside it is cold and not ignited, the high Q of both the slot 14 and the resonator 5 makes it easier to ignite the bulb 6. However, since 'Q' of the resonator 5 becomes much lower as the bulb 6 is fully ignited, it is difficult to maintain a good matching in its normal operating state. Thus, the width of the slot 14 should be determined accordingly.

In the present invention, the width of the slot 14 can be approximately 12 mm, and the position of the slot 14 is determined where the matching is the most suitably made after the bulb 6 is completely lit up. By doing that, the present invention accomplishes quite reliable ignition performance and an effective and stable operation at the same time.

Figure 12A:
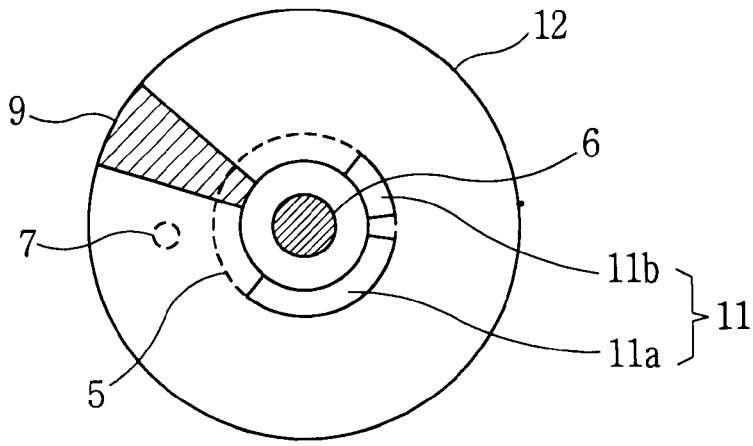
Figure 12B:
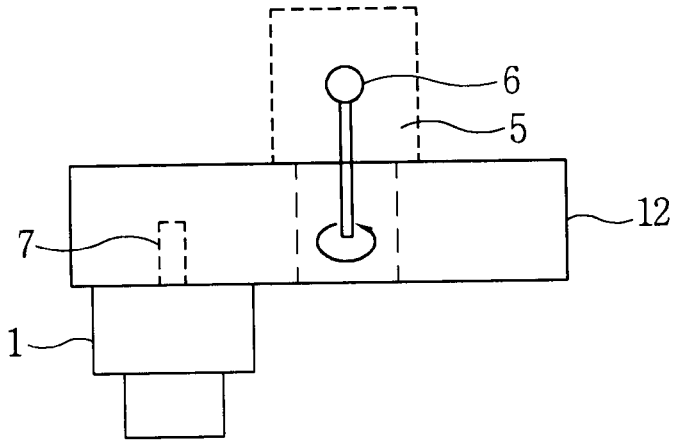

FIGS. 12A and 12B show a structure of a waveguide adapted to an electrodeless lamp in accordance with yet another embodiment of the present invention.

This embodiment is featured in that a waveguide 12 with a rectangular cross section is rolled into cylindrical form over the 'H' side. In this case, the cylindrical second resonator 5 jointly owns a part of the 'E' side of the waveguide 12, and the waveguide 12 and the second resonator 5 are coupled by the jointly-owned portion, that is, by the coupling slots 11 installed on the 'E' side (front surface) of the waveguide. The coupling slots 11 operate as a directional coupling structure consisting of two slots 11*a* and 11*b*, of which the second slot 11*b* is shorter than the first slot 11*a* for the purpose of improving the matching characteristics. The magnetron 1 is coupled to a rear surface of the waveguide 12. In the present invention, the overall apparatus can be within the outer diameter of the waveguide 12 on the basis of the axis of the bulb 6, which is very advantageous for designing a lamp bulb system having a cylindrical external appearance. In FIGS. 11A to 12B, reference numbers 7 and 9 show an antenna of the magnetron 1 and a separating wall.

As so far described, according to the coupling structure of a waveguide and an applicator of the present invention, a variation of the load does not affect the electromagnetic wave generator without requiring expensive devices such as a waveguide tuner or a circulator, so that the life of the electromagnetic wave generator is increased and the system operates stably. Also, the out-of-service time of the system for the replacement of the electromagnetic wave generator can be reduced.

In addition, the matching state of the system does not need to be adjusted to follow the variation of the load state. Using a tuner causes inconvenience in that the matching state must be adjusted according to the variation of the load state, but in the present invention, a load of a different kind or different characteristics can be used without changing the system.

Since the matching state of the system is always favorably maintained, the life of the electromagnetic wave generator such as magnetron is extended and the system operates stably, and thus the efficiency of the system can be remarkably improved.

Moreover, by using the waveguide, which also serves as a resonator, a stable operation state can be maintained over a wide range of load states. For example, referring to the electrodeless lamp, as for the mode before and after the bulb is ignited, the waveguide and the resonator guarantee ignition and support of stable discharge, and the phenomenon of system failure can be prevented during the mode switching.

Since the ignition of the bulb is easy, no extra equipment is necessary to help ignite the bulb, which simplifies the system, and thus, production costs can be reduced.

Furthermore, by coupling the waveguide and the resonator by using the coupling slots, the reflected wave is prevented from turning back to the magnetron, and the rotational polarization can be excited into the resonator. Accordingly, the uniformity of the electromagnetic field distribution within the resonator is improved, so that the plasma discharge inside the bulb is stably maintained, and as the necessity of rotating the bulb is reduced, and damage to the bulb can be prevented. As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A coupling structure of a waveguide and an applicator comprising:

an electromagnetic wave generator;

a waveguide for transmitting an electromagnetic wave generated by the electromagnetic wave generator, said waveguide having a semicircular, a circular or an oval shape; and an applicator for receiving the electromagnetic wave through the waveguide and applying the electromagnetic wave to a load, wherein a wall of the waveguide and the applicator is partially or wholly shared and has one or more slots positioned therein, and the waveguide has a length equal to an integer times one-half the wavelength of the electromagnetic wave traveling within the waveguide.

2. A coupling structure of a waveguide and an applicator comprising:

an electromagnetic wave generator;

a waveguide for transmitting an electromagnetic wave generated by the electromagnetic wave generator; and an applicator for receiving the electromagnetic wave through the waveguide and applying said electromagnetic wave to a load, wherein a wall of the waveguide and the applicator is partially or wholly shared, said wall having at least two slots positioned therein, and the interval between a center portion of one slot to that of an adjacent slot is equal to one-fourth of the wavelength of the electromagnetic wave traveling within the waveguide, wherein said at least two slots are disposed along a lengthwise direction of the waveguide, and along a direction that crosses the axial direction of the applicator.

3. The coupling structure of claim 2, wherein the waveguide is comprised of two cylinders having an inner wall and an outer wall so as to define a path having a rectangular cross-section in order to direct the electromagnetic wave from the electromagnetic wave generator.

4. A coupling structure of a waveguide and an applicator comprising:

an electromagnetic wave generator;

a waveguide for transmitting an electromagnetic wave generated by the electromagnetic wave generator; and an applicator having a cross-section with a circular or an oval shape for receiving the electromagnetic wave through the waveguide and applying the electromagnetic wave to a load, wherein a wall of the waveguide and the applicator is partially or wholly shared and has one or more slots positioned therein, and the waveguide has a length equal to an integer times one-half the wavelength of the electromagnetic wave traveling within the waveguide.

5. The coupling structure of claim 4, wherein the load is a lamp bulb emitting light in accordance with the electromagnetic wave received by the applicator.

6. The coupling structure of claim 4, wherein the shared wall has at least two slots, and an interval between a center portion of one slot to that of an adjacent slot is equal to one-fourth times the wave length of the electromagnetic wave traveling within the waveguide.

7. The coupling structure of claim 4, wherein the width of any one slot is greater than three times the thickness of the wall in which the any one slot is located.

8. The coupling structure of claim 4, further comprising an electromagnetic wave absorbing unit at one end portion of the waveguide opposite another end portion of the waveguide where the electromagnetic wave is introduced.

9. The coupling structure of claim 4, wherein any one slot is disposed along a lengthwise direction of the waveguide, and along a direction that crosses the axial direction of the applicator.

10. The coupling structure of claim 4, wherein the waveguide has a semicircular, a circular, or an oval shape.

11. The coupling structure of claim 4, wherein the waveguide is formed around the axis of the applicator, in a manner such that the form of the electromagnetic wave progressing within the waveguide makes concentric circles or concentric circular arcs with the cross-section of the applicator.

12. The coupling structure of claim 4, wherein the waveguide is comprised of two cylinders having an inner wall and an outer wall so as to define a path having a rectangular cross-section in order to direct the electromagnetic wave from the electromagnetic wave generator to the applicator.

13. A waveguide structure comprising:

A) a two-cylinder structure having an inner wall and an outer wall so as to define a path having a rectangular cross-section for directing an electromagnetic wave, said inner wall and outer wall having a separating wall disposed therebetween;

wherein an electromagnetic wave generator is affixed to the outer wall, the outer wall having one or more slots are disposed thereon adjacent to the location where an applicator is coupled so as to pass the electromagnetic wave generated by the electromagnetic wave generator to the applicator.

14. The waveguide structure of claim 13, wherein said one or more slots are disposed along a lengthwise direction of the waveguide, and along a direction that crosses the axial direction of the applicator.

15. The waveguide structure of claim 13, wherein the electromagnetic wave generator is coupled to one side of the separating wall, and an electromagnetic wave absorbing unit is installed on an opposite side of the separating wall.

16. The waveguide structure of claim 13, wherein the waveguide has a length equal to an integer times one-half of the wave length of the electromagnetic wave traveling within the waveguide.

17. The waveguide structure of claim 13, wherein the one or more slots comprise two or more slots disposed thereon.

18. The waveguide structure of claim 17, wherein the interval between a center portion of one slot to that of an adjacent slot is equal to one-fourth the wavelength of the electromagnetic wave traveling within the waveguide.

19. A coupling structure of a waveguide and an applicator comprising:

an electromagnetic wave generator;

a waveguide including two cylinders having an inner wall and an outer wall so as to define a path of rectangular cross-section in order to direct the electromagnetic wave from the electromagnetic wave generator; and an applicator coupled to the inner wall of the waveguide, said applicator having a cross-section with a circular or an oval shape, a portion of said applicator forming a concentric circle with the waveguide for applying the electromagnetic wave directed from the waveguide to a load.

20. The coupling structure of claim 19, wherein the applicator has a lamp bulb affixed therein for emitting light in accordance with the electromagnetic wave received by the applicator.

21. The coupling structure of claim 19, wherein the applicator has a liquid load affixed therein through which a flowing liquid which is heated by the electromagnetic wave is able to pass.

22. The coupling structure of claim 19, wherein the electromagnetic wave generator is coupled to the outer wall of the waveguide, and the inner wall of the waveguide has one or more slots so as to pass the electromagnetic wave to the applicator.

23. The coupling structure of claim 19, wherein the electromagnetic wave generator is coupled to the outer wall of the waveguide, and one or more slots are disposed on the inner wall of the waveguide to which the applicator is coupled.

24. The coupling structure of claim 19, wherein one or more slots are disposed on the inner wall of the waveguide where the applicator is coupled, and the electromagnetic wave generator is coupled to the outer wall of the waveguide.

25. A coupling structure of a waveguide and an applicator comprising:

an electromagnetic wave generator;

a waveguide for transmitting an electromagnetic wave generated by the electromagnetic wave generator; and an applicator for receiving the electromagnetic wave through the waveguide and applying said electromagnetic wave to a load, wherein a wall of the waveguide and the applicator is partially or wholly shared, said wall having one or more slots positioned therein, and the one or more slots are disposed along a lengthwise direction of the waveguide, and along a direction that crosses the axial direction of the applicator.

26. The coupling structure of claim 25, wherein the waveguide is comprised of two cylinders having an inner wall and an outer wall so as to define a path having a rectangular cross section in order to direct the electromagnetic wave from the electromagnetic wave generator.

* * * * *